United States Patent [19]

Cheng et al.

[11] 4,111,338

[45] Sep. 5, 1978

[54] WALL MOUNTED ACTUATOR FOR AEROSOL CAN

[75] Inventors: Robin Cheng; Kenneth MacLean Cross, both of Penshurst, Australia

[73] Assignee: 3C Chemical Laboratories Pty. Limited, Penshurst, Australia

[21] Appl. No.: 738,211

[22] Filed: Nov. 3, 1976

[30] Foreign Application Priority Data

Mar. 16, 1976 [AU] Australia ..... PC5234

[51] Int. Cl.[2] ..... B05B 17/00

[52] U.S. Cl. ..... 222/180; 222/402.13; 239/282; 251/251

[58] Field of Search ..... 222/180, 181, 505, 509, 222/402.13, 174; 239/274, 282; D6/87, 95; D9/5, 291; 251/231, 251, 320; 141/360–363

[56] References Cited

U.S. PATENT DOCUMENTS

| | | | |
|---|---|---|---|
| 3,100,065 | 8/1963 | Gross | 222/180 |
| 3,137,414 | 6/1964 | Steinkamp | 222/402.13 X |
| 3,185,350 | 5/1965 | Abplanalp et al. | 222/402.13 X |
| 3,220,613 | 11/1965 | Palmer et al. | 222/174 |
| 3,269,610 | 8/1966 | Fuls | 222/509 X |
| 3,809,319 | 5/1974 | Kimura | 222/180 X |

*Primary Examiner*—Stanley H. Tollberg
*Assistant Examiner*—David A. Scherbel
*Attorney, Agent, or Firm*—Ladas, Parry, Von Gehr, Goldsmith & Deschamps

[57] ABSTRACT

A wall mountable holder to dispense the contents of an aerosol can, the holder comprising an outer casing of two parts dimensioned to contain within it a pressurized can, the two parts of said container being pivotally attached at their upper end and having projections to engage the dispensing nozzle of said can so that upon relative movement of said two parts toward each other beyond a predetermined position said means cause movement of said nozzle to thereby release contents from within said can.

4 Claims, 4 Drawing Figures

WALL MOUNTED ACTUATOR FOR AEROSOL CAN

The present invention relates to dispensing apparatus and more particularly but not exclusively to apparatus to dispense the contents from within a pressurised can.

The common use of aerosol cans to dispense air fresheners, pestacides and the like in an atomised form into a room has lead applicant to develop a holder to facilitate the use of such pressure pack cans and to provide an attractive unit to house the can. The holder in its preferred form is adapted to be attached to the wall of a room within which the spray is to be dispersed.

It is the object of the present invention to provide a holder which engages the dispensing nozzle of a pressurised can to dispense the contents from within said can.

Accordingly in general form the present invention is a holder dimensioned to support within it a pressurised can with a dispensing nozzle, said holder comprising an outer casing of two parts, a pivot connecting the two parts thereby allowing limited relative rotational movement between the two parts, one of the parts being adapted to support said can, and wherein the other of the two parts is provided with means to engage said nozzle so that upon relative movement between said two parts beyond a predetermined position said means causes movement of said nozzle to thereby release at least part of the contents from within said can.

Preferred forms of the present invention will now be described by way of example with reference to the accompanying drawings therein:

Figure 1:
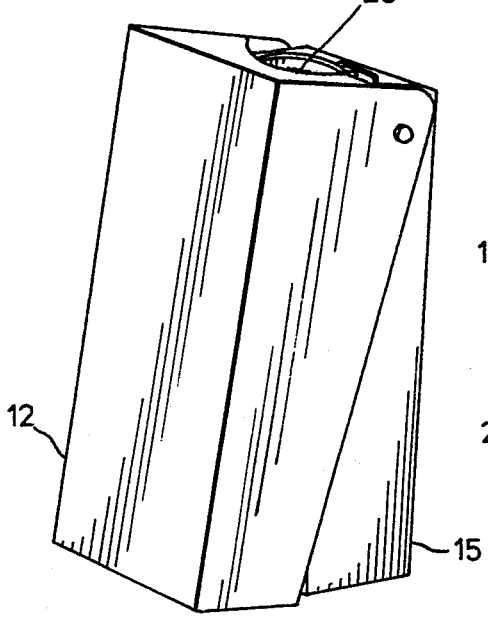
FIG. 1 is a perspective view of a holder; of generally rectangular shape; embodying the present invention.
Figure 2:
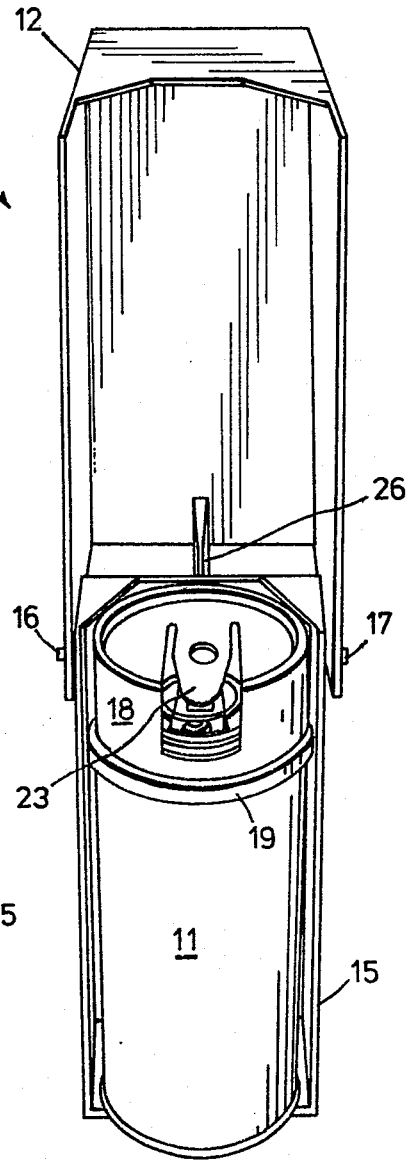
FIG. 2 depicts the holder of FIG. 1 with a pressure-pack can located therein.
Figure 3:
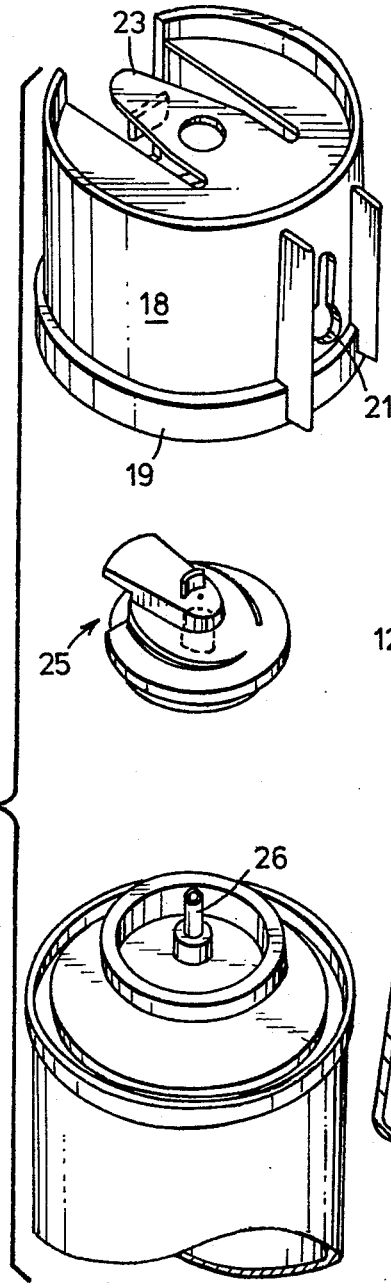
FIG. 3 is an exploded view of the dispensing apparatus located on the can depicted in FIG. 2.
Figure 4:
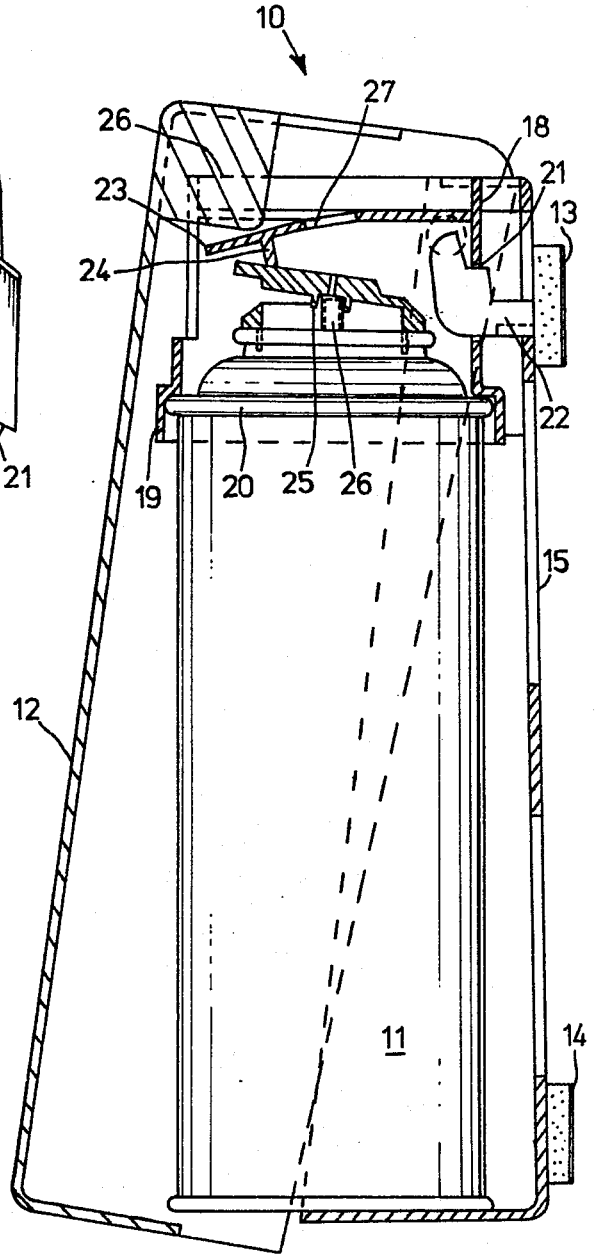
FIG. 4 is a cross-sectional view of the holder and can of FIGS. 1 and 2.

The wall unit 10 of FIGS. 1 to 4 is adapted to support within it a pressurised can 11 and to dispense the contents from within the can upon the movement of the front cover 12 toward the can 11 beyond the position depicted in FIG. 4. The unit 10 is wall mountable by being provided on its rear cover 15 with adhesive pads 13 and 14, alternatively holes may be provided through which screws may be placed. The two covers 12 and 15 are pivotally attached at points 16 and 17. The points 16 and 17 are moulded integral with the cover 15 and engage corresponding holes in the cover 12 located on top of the can 11 and adapted to locate and hold the can within the holder is dispensing cap 18. The cap 18 is dimensional at its bottom flange 19 to tightly engage the top rim 20 of the can 11 and is provided with a passage 21 through which hook 22 passes to hold the can 11 with the cap 18 in position. The hook 22 is moulded integral with the cover 15.

The cap 18 is provided with a flexible tongue 23 having a projection 24 to engage the dispensing nozzle 25 of the can 11. To interact with the tongue 23 is projection 26 moulded integral with the cover 12. In the rest position illustrated in FIG. 4 the projection 26 rests on the tongue 23 which in turn rests on the nozzle 25. However upon an operator pressing the cover 12 toward cover 15 the projection 26 causes downward movement of the tongue 23 and projection 24 to move the nozzle 25. As a result of movement of the conduit 26 liquid is forced from within the can 11 through the nozzle 25 to be atomised thereby and to be sprayed from within the container through passage 27 and the opening 28. Due to the spring loaded action of the conduit 26, upon the operator removing the applied force from the cover 12, the cover is returned to the rest position illustrated in FIG. 4. It should also be noted that the cap 18 could be moulded integral with the dispensing nozzle 25 to minimise moulding costs.

When the can is empty it is removed by pivoting the cover 12 clockwise (with reference to FIG. 4) until it is above cover 15 to thus expose the can 11 and cap 18. The can 11 may then be removed by also pivoting it clockwise and moving it to the left. In this manner the hook 22 will pass through opening 21. To minimise cost the nozzle 25 could be moulded integral with the cap 18.

It should be appreciated that a holder embodying the present invention could be constructed to house more than one can by providing a corresponding number of front covers to actuate the dispensing nozzles of the cans.

What we claim is:

1. A combination to be mounted on a wall comprising a cap dimensioned to be fitted to and securely engage the top of a pressurized can with a dispensing nozzle, said cap having a flexible tongue to operate said nozzle; a holder dimensioned to surround and support within it the pressurized can with its dispensing nozzle, said holder having an outer casing of two parts, a pivot connecting the two parts thereby allowing limited pivotal movement between the two parts, one of the parts being adapted to engage said cap so as to support said can within said holder, and wherein the other of the two parts is provided with means to engage said tongue so that upon relative pivotal movement between said two parts beyond a predetermined position said means causes movement of said tongue to operate said nozzle to thereby release at least part of the contents from within said can via said nozzle.

2. A combination according to claim 1, wherein said two parts are pivotally attached at the upper portions so that when in use the two parts are biased together under the influence of gravity.

3. A combination according to claim 2, wherein said means includes a projection extending in a plane perpendicular to the axis of rotation of the two parts and adapted to directly engage said nozzle.

4. A combination according to claim 3, wherein said tongue is provided with a passage to allow spray ejected from said nozzle to pass through said tongue.

* * * * *